United States Patent [19]

Rossetti

[11] Patent Number: 4,705,083

[45] Date of Patent: Nov. 10, 1987

[54] METHOD AND MACHINE FOR BATCHING COLORING AGENTS INTO PAINTS AND VARNISHES

[75] Inventor: Edoardo Rossetti, Finale Emilia, Italy

[73] Assignee: Corob S.R.L. Automatic Machinery Project, Modena, Italy

[21] Appl. No.: 878,955

[22] PCT Filed: Oct. 9, 1985

[86] PCT No.: PCT/EP85/00528

§ 371 Date: Jun. 11, 1986

§ 102(e) Date: Jun. 11, 1986

[87] PCT Pub. No.: WO86/02320

PCT Pub. Date: Apr. 24, 1986

[30] Foreign Application Priority Data

Oct. 12, 1984 [IT] Italy ..... 40094 A/84

[51] Int. Cl.[4] ..... B65B 1/30

[52] U.S. Cl. ..... 141/104; 141/83; 141/1; 141/98; 364/479; 366/605; 366/142; 366/161

[58] Field of Search ..... 141/100, 103, 104, 234, 141/98, 1, 83; 364/479; 366/605, 137, 161, 162, 142

[56] References Cited

U.S. PATENT DOCUMENTS

| | | | |
|---|---|---|---|
| 2,787,402 | 4/1957 | Stiner et al. | 141/104 X |
| 2,848,019 | 8/1958 | Corbin et al. | 141/100 |
| 2,923,438 | 2/1960 | Logan et al. | 141/104 X |
| 3,670,785 | 6/1972 | Heiss et al. | 141/9 |
| 4,275,822 | 6/1981 | Juffa et al. | 364/479 X |
| 4,314,653 | 2/1982 | Sindoni | 222/41 |
| 4,332,483 | 6/1982 | Hope et al. | 361/132 |
| 4,403,866 | 9/1983 | Falcoff et al. | 366/132 |

FOREIGN PATENT DOCUMENTS

| | | |
|---|---|---|
| 2529101 | 2/1977 | Fed. Rep. of Germany . |
| 3201221 | 7/1983 | Fed. Rep. of Germany . |

OTHER PUBLICATIONS

Feinwerktechnik and Messtechnik, vol. 91, No. 3, 5/1983 pp. 111, 112.

AufbereitungStechnik, vol. 23, No. 1, 1/1982 pp. 1–7.

*Primary Examiner*—Henry J. Recla

*Assistant Examiner*—Ernest G. Cusick

*Attorney, Agent, or Firm*—Lowe Price LeBlanc Becker & Shur

[57] ABSTRACT

A machine for automatically batching coloring agents for paint or varnish is disclosed. The machine includes a computerized method for calibrating the amount of coloring agent dispensed with solenoid valves which calculate the viscosity and the delay time for opening and closing the valves so that coloring agents are dispensed with a minimum of less than plus or minus 1% error.

6 Claims, 9 Drawing Figures

Fig. 1
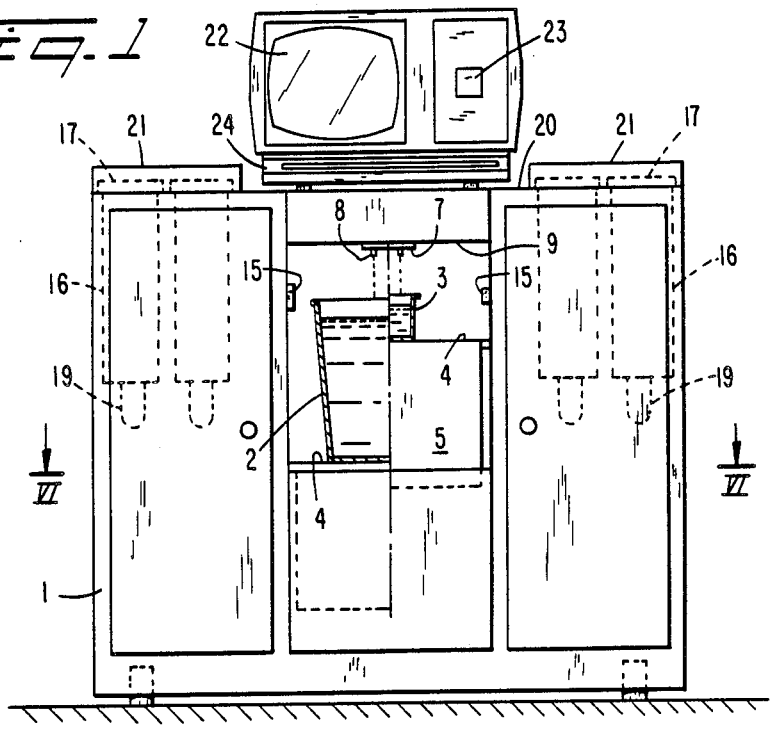
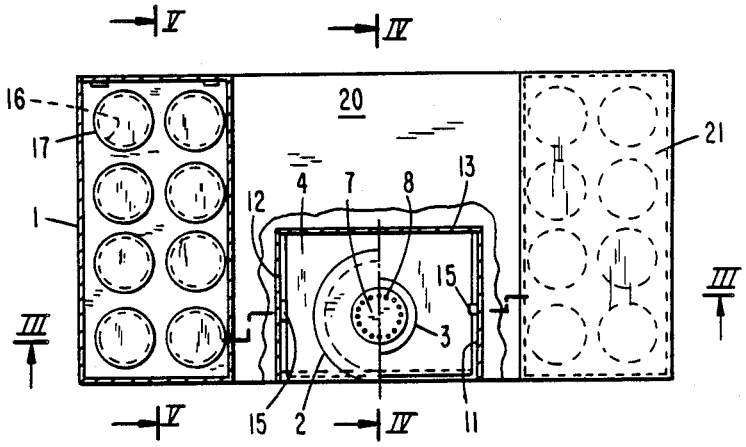
Fig. 2

METHOD AND MACHINE FOR BATCHING COLORING AGENTS INTO PAINTS AND VARNISHES

BACKGROUND OF THE INVENTION

1. Field of the Invention

This invention relates to a method and machine for batching coloring agents into paints and varnishes by volume, and to a machine which will dispense said coloring agents accurately.

2. Description of the Prior Art

The prior art embraces machines which are manually operated, semiautomatic or fully automatic plunger types featuring a set of vertically disposed dispensers with respective cylinders, equal in number to the colors to be batched into the medium. Each cylinder contains and supplies a single color. The accuracy of such machines, particularly questionable in the case of manual operation because of human error, improves with automation. Nevertheless, the hydraulic cylinders used to control reciprocating motion of the plungers in such machines are expensive and include additional drawbacks. There is always considerable downtime due to the return stroke of the plunger which refills the dispenser cylinder with coloring agent. In addition, such machines are characterized by low efficiency, especially in the conversion of electrical energy to mechanical energy.

The prior art also contains automated machines which utilize positive displacement pumps and solenoid valves with individual direct current motors and couplers, one for each color to be dispensed. Such machines recirculate excess color via a closed circuit. Although this machine is more desirable than the above described machines, this type is also economically inefficient because of the need for a large number of direct current motors, which require setting, attendant servicing, and the like.

When automated, machines in the prior art also become noticeably large and cumbersome.

There is an every increasing requirement for a greater number of shades in each color manufactured and this ever increasing need accentuates the problem of batching accurately. The prior art machines tend to be accurate only on an order of 5 to 10%. This accuracy does not permit obtaining all shades currently demanded and mixes often do not correspond to the actual shade called for and shades themselves become confused with each other.

SUMMARY OF THE INVENTION

In view of the above described prior art it is highly desirable to provide a means for batching single colors with the maximum possible volumetric accuracy. This then would achieve the maximum possible extension of a number of shades which could be batched while ensuring that one shade remains distinguishable from another. This would also increase the range of samples of shades which would be available without confusion. It would then be desirable to limit the error in batching of coloring agents to a bare minimum of say plus or minus 1% or even less, regardless of the viscosity of the coloring agent. It would also be desirable to provide such a machine which is simple, compact, and cost effective.

It has now been discovered that the problem can be resolved according to the method of the instant invention wherein lower n pumps, serving n solenoid valves dispense one or more of the n coloring agents into the medium. All of said pumps are operated by a single electric motor, and more particularly a microprocessor controlled stepping motor such that coloring agents are dispensed in portions equivalent to a proper or improper fraction, or to the integer (that is less than or greater than or equal to 1) of a given droplet, equal to 1/m of the volumetric unit of measure, e.g. fluid ounces, and definable as a quantity the admixture of which marks the distinction between single shades. The droplet in question is defined p, a nominal value reflecting the number of half-steps that must be completed by the rotor of the electric motor, according to pump flow rate per revolution of the motor itself. The droplet delivered by the pump is weighed upstream of the respective solenoid valve, and the effective weight thus registered is compared with a nominal weight, computed by multiplying the specific weight of the coloring agent by the volume obtainable from the pump with p half-steps of the motor. This comparison then determines the correct number of half-steps x required to produce the droplet by weight of a linear equation.

To offset the time lapse required for operation of each respective solenoid valve in opening and closing (the former longer than the latter), a nominal value of operational delay R is computed, in half-steps, from the difference between the two time lapses and the number of pulses that the motor receives per unit of time. The droplet is the reweighed downstream of the solenoid valve, whereupon effective and nominal weights are compared once again utilizing the same procedure as for comparison upstream so as to permit converting the nominal number R for half-steps into an effective number y, thereby arriving at the preset level of batching accuracy.

The machine of this invention consists of a compact cabinet provided with two side compartments in a preferred embodiment. The top of each side compartment has openings along either side for the insertion of containers and respective stirrers n/2 in number, for holding coloring agents. A central enclosure between the two side compartments is provided with a platform which can be raised and lowered on guides by an actuator. The container holding the medium is positioned on the platform and photocells are provided which identify the type of container. A circular bank of nozzles for dispensing coloring agents, n in number, are provided, each nozzle being coupled to a solenoid valve downstream of a respective pump.

The stepping motor is located centrally below the platform and it operates the n pumps by way of transmission links and timing belt and pulley drives at either side thereof. A computer with a screen, keyboard, and printer sits on top of the cabinet. The main circuit board of the computer interconnects six additional boards: a central processing unit (CPU); a function-select, photocell and sensor input control; six sensors for detecting proximity of six different sizes of containers, singly, in relation to the vertically movable platform and to its position; a video display, keyboard, and printer; outputs, n in number, to the solenoid valves; system control functions (n stirrers, platform raise/lower actuator, motor power supply and rotor step count); and a memory.

Accordingly it is an object of this invention to provide a computer actuated automatic dispensing machine for batching coloring agents for paint or varnish accurately and automatically.

It is another object of this invention to provide a method for operating a dispensing machine whereby coloring agents are accurately dispensed by volume in a machine calibrated for the viscosity of the coloring agents and the time delay necessary for dispensing the coloring agents.

BRIEF DESCRIPTION OF THE DRAWINGS

These and other objects will become readily apparent with reference to the drawings and following description wherein:

FIG. 1 is a front elevation of the machine of this invention designed to batch sixteen coloring agents with the left hand half of the drawing illustrating the position occupied by the largest container of the medium during mixing and the right half illustrating the position occupied by the smallest size container;

FIG. 2 is a plan view of the machine of FIG. 1 partially in section;

DESCRIPTION OF THE PREFERRED EMBODIMENTS

Figure 3:
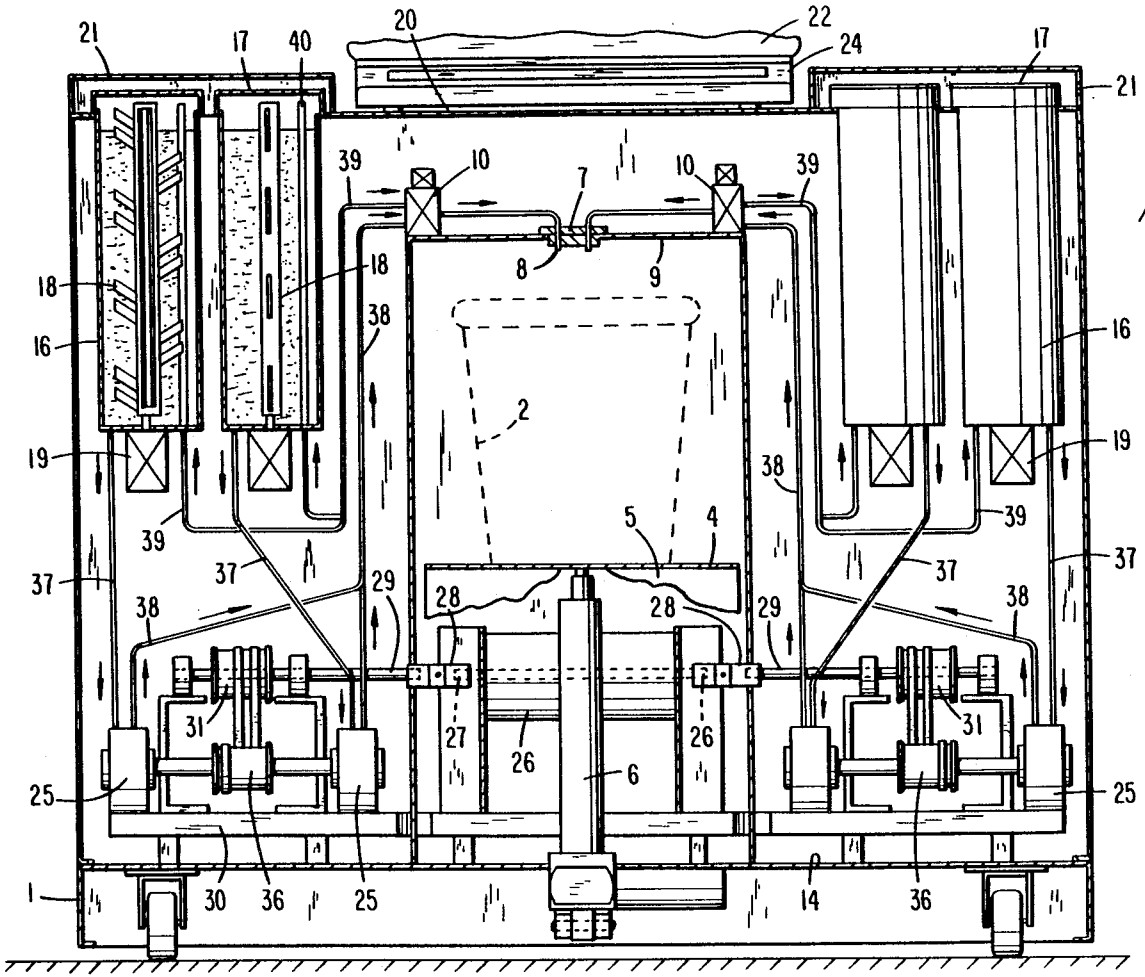
FIG. 3 is a vertical cross section along lines III—III of FIG. 2 in enlarged scale.
Figure 5:
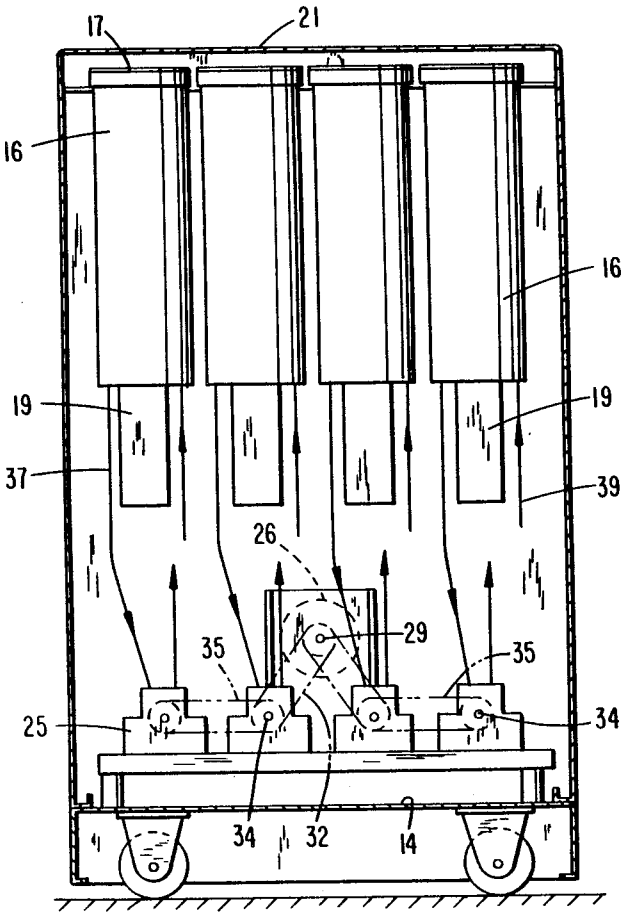
FIG. 5 is a vertical longitudinal section along lines V—V of FIG. 2 in enlarged scale showing the transmission links between the motor and the sixteen pumps.

With reference to the drawings the device of this invention includes a cabinet 1 housing the machine adapted to hold either containers 2 or 3 of the medium, paint or varnish. Either container 2 or 3 is positioned as shown on platform 4 of an L-shaped support 5 that is slidable vertically by an electrically operated linear actuator 6. See FIGS. 3 and 4. Actuator 6 is hinged at its lower end to the lower portion of framework of cabinet 1. A disc 7 to which the sixteen batching nozzles 8 for the coloring agents are mounted is in turn mounted on shelf 9 with sixteen respective solenoid valves 10. Cabinet 1 includes a top surface which is an open fronted box structure with vertical walls 11, 12 and 13 which rest on the bottom shelf 14 of the cabinet 1. A photocell 15 detects either the presence of absence of a container on platform 4 or the presence of a container of incorrect size. The coloring agents are stocked in containers 16 (of which there are sixteen in the embodiment shown) each with a lid I7 and an internal stirrer 18 turned by a respective electric motor 19. Each container is positioned vertically in a respective opening in the top surface 20 of the cabinet 1 resting on the lip of the opening itself; the top surface 20 has a cover 21 at each side, hinged at the rear of the cabinet 1 so as to permit access to the two sets of eight containers 16. The computer video display 22, printer 23 and keyboard 24 are also disposed on top of the cabinet 1. The machine comprises positive displacement pumps 25 (one for each container 16) the flow rate of which can be varied by variation of the speed of rotation of the single electric motor 26, a stepping motor. The rotor of motor 26 is designed to locate four hundred distinct angular positions within one revolution. The double extending shaft 27 of motor 26 connects by way of respective coupling 28 with a relative input shaft 29 journalled to a base 30 located inside cabinet 1. A wide face timing pulley 31 keyed to each input shaft 29 transmits drive by way of a relative timing belt 32 to two identical pulleys 33 keyed to the common drive shafts 34 of four pumps 25 mounted in pairs to the base 30. Rotation imparted at either side of the machine to these pulleys 33 is relayed in turn by way of further belts 35 to the pulleys 36 of the remaining two pairs of pumps 25. Therefore, there are two drive systems, one on either side of the motor each one driving eight pumps. It will be obvious to those skilled in the art that the number of pumps can be changed to any desired number.

Figure 4:
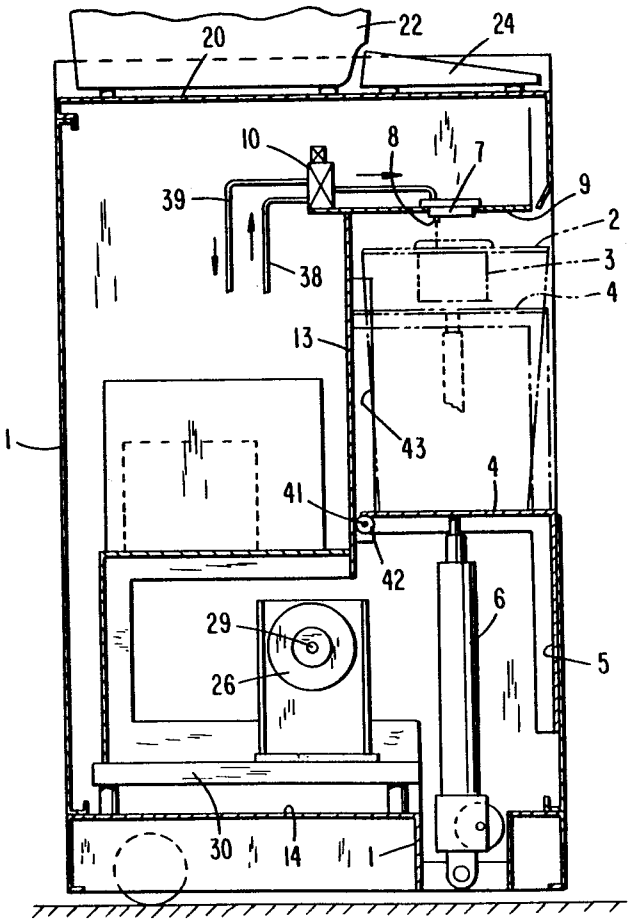
FIG. 4 is a vertical section along lines IV—IV of FIG. 2, the longitudinal axis of the machine, in enlarged scale.
Figure 6:
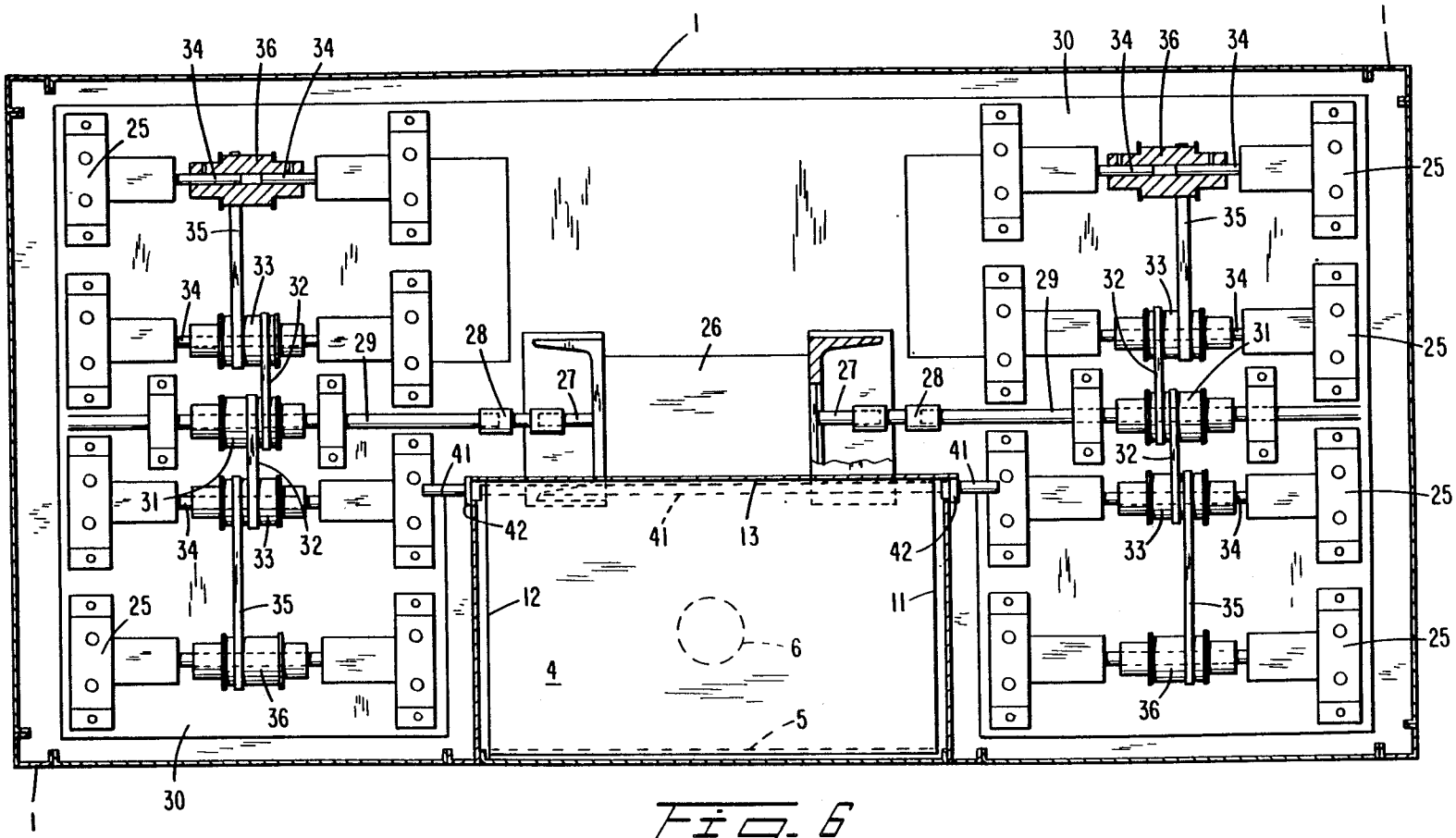
FIG. 6 is a horizontal cross-sectional view along lines VI—VI of FIG. 1 in enlarged scale.
Figure 7:
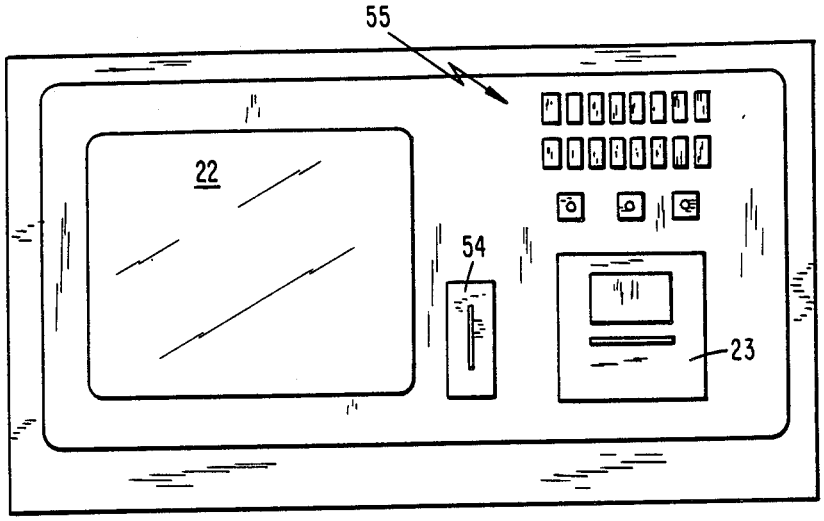
FIGS. 7 and 8 show the computer video display and key layouts, respectively.
Figure 8:
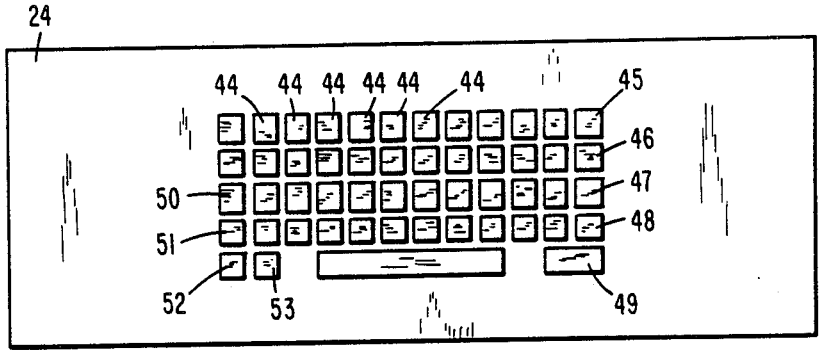

The bottom of each container 16 connects with the intake of a respective pump 25 via a tube 37. A further tube 38 connects the pressure outlet of each pump 25 with a respective solenoid valve 10, and a recycle tube 39 returns the excess coloring agent from the valve to the bottom of the respective container 16. An extension 40 of the recycled tube 39 is located inside the container 16. As shown in FIG. 4, a double extending shaft 41 extends from either side of the L-shaped support 5 at its rear end and has rollers 42 which locate in vertical guides 43, integral with walls 11 and 12 of the cabinet 1. This same shaft serves as the trigger element for the container size proximity sensors. With reference to keypad 24, as shown in FIG. 8, there are the noted keys for entering quantities of medium to which coloring agents may be admixed 45 through 53. The keys governing the following functions are provided in this embodiment:

- Key 45 - check on coloring agent batch data at the start of each work shift;
- Key 46 - check on level of coloring agent in each container;
- Key 47 - display remarks;
- Key 48 - print out batch formula (via printer 23);
- Key 49 - dispense selected coloring agents from nozzles 8;
- Key 50 - memorize batch formula;
- Key 51 - access tables with setting of viscosity, delay times for operation of solenoid valves 10, and speed of motor 26;
- Key 52 - select from batch formula already on file;
- Key 53 - develop new batch formula, which can also be memorized, by manual operation of nozzles.

All of the above functions are displayed on the video display 22. A slot 54 in which to insert cassettes or cards with formula other than those currently on file is also provided and an array of indicators 55, one to each coloring agent, is further provided.

Figure 9:
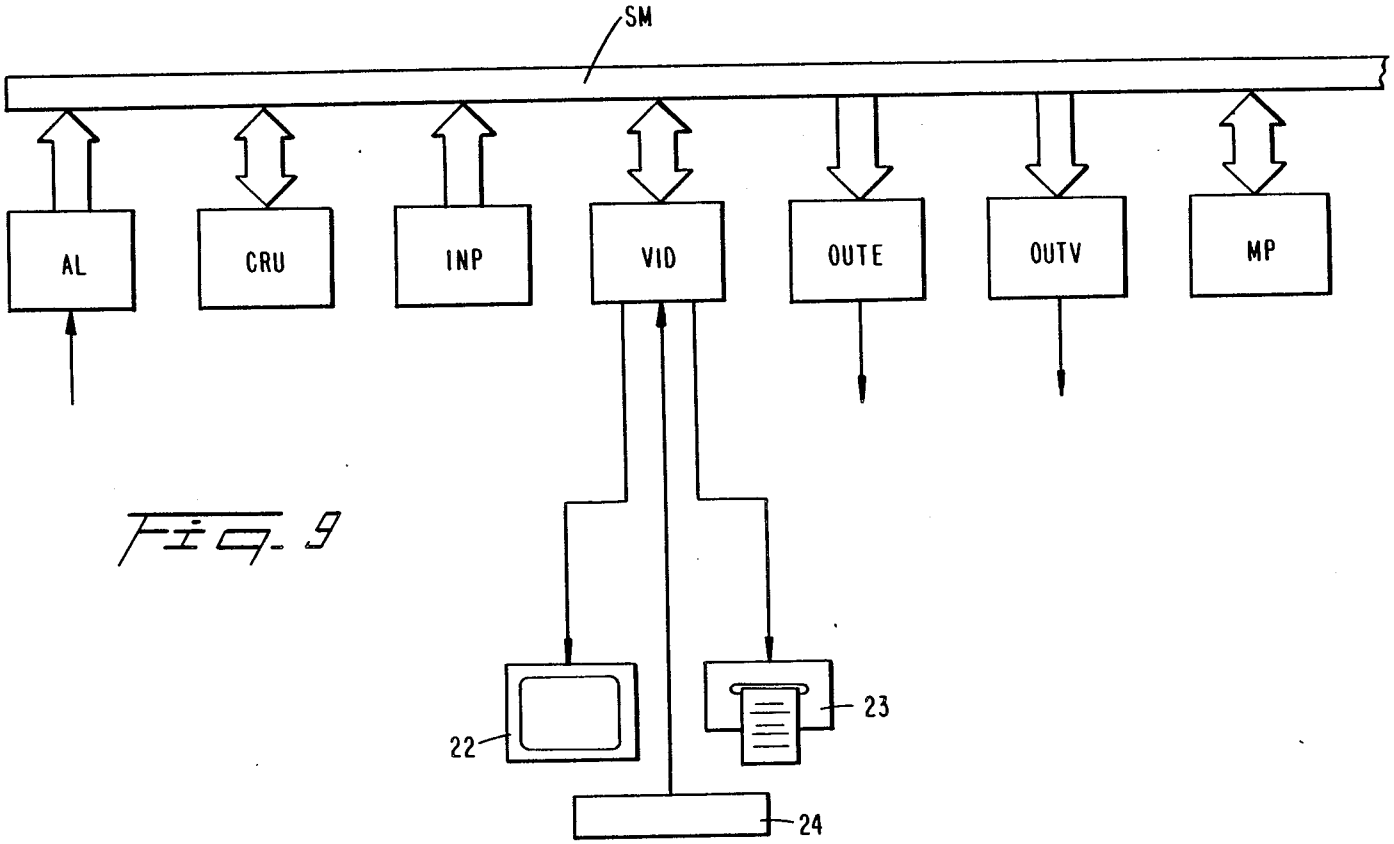
FIG. 9 is a block diagram of the microprocessor which illustrates the arrangements of the circuit boards in the monitored enclosure.

With reference to the block diagram of FIG. 9, AL denotes power supply to the main circuit board SM, from which further circuit board connections are taken:

- CPU - central processing unit interface;
- INP - inputs relative to the selection of machine functions, the photocell II detecting position of the paint/varnish container 2 or 3, and the six sensors which detect proximity of the six size of containers and relative positions of the platform 4;
- VID - video key pad and printer interface;
- OUTE - outputs controlling the sixteen solenoid valves 10;

OUTV - outputs controlling machine system, sixteen stirrers, ascent and descent of platform 5, power supply to the motor 26, and rotor step count;

MP - permanent memory interface;

To operate the device of this invention the following procedure applies:

Having selected the number of the shade desired from a predetermined formula sample card the operator depresses key 52 and enters the number via the video display whereupon, using one of the keys denoted 44, the quantity of medium to be colored is selected by determining the size of the container 2 or 3. With the container in position on the platform 4, the operator depresses key 49 to commence batching of the coloring agent or agents from one or more nozzles. Mixed coloring can be produced by utilizing key 53. The method is carried into effect utilizing three tables.

The table of viscosity settings for the selected coloring agents is accessed with key 51 and consists of sixteen nominal values one for each agent, which can be obtained singly as follows:

Assuming a positive displacement pump 25 with flow rate $Q=6l/min$ at 1400 $min^{-1}$ and a motor 26 capable of 400 half-steps per revolution, flow rate Q1 of the coloring agent per revolution is determined at $Q1=6000/1400=4.2857\ cm^3/rev$, and from this figure one can calculate the flow rate Q2 per half-step of the motor as $Q2=4.2857/400=1.071\times10^{-2}\ cm^3/half\text{-}step$. With reference to metric fluid ounces, equivalent to the U.S. fluid ounce of 29.5735 $cm^3$ plus 5.67%, and given that 1/96 of the metric fluid ounce equals 0.3255 $cm^3$, it can be calculated that the number of half-steps required to batch 1/96 of a fluid ounce in question is $0.3255/0.01071=30.38$. One skilled in the art will be aware that 1/96 of a fluid ounce of coloring agent is the fraction which conventionally, marks the distinction between one color shade and the next. Using the machine according to this invention, it becomes possible to even halve this fraction, thereby doubling the range of shades available.

The table of solenoid valve operation delay times is also accessed with key 51, and consists likewise of sixteen nominal values, one to each coloring agent. The values are obtained as follows:

Given the pulse frequency of which the motor 26 operates, for example 1216 $H_z$ at a speed of 182.4 min , and given the time-lapses produced by the opening movement of the valve ($15\times10^{-3}$ sec) and its closing movement ($8\times10^{-3}$ sec), the difference between these two is $7\times10^{-3}$ sec, so that the delay produced by operation of the valve, expressed in half-steps, is $1216/1000\times7=8.512$. For example, if one wish to batch a quantity of coloring agent equal to 50/96 of a European metric fluid ounce, the nominal number of half-steps needed to dispense 1/96 of a metric fluid ounce having been established at 30.38, then multiplication will produce the figure of 1519 half-steps, to which must be added the delay of 8.512 half-steps, thereby producing an effective overall time-lapse of $R=1527.512$ half-steps. The motor speed table, likewise accessed by key 51 and utilizable in the same way, consists of a delay the entity of which is set at, say, $1\times10^{-5}$ sec per half-step. Such a delay is utilized to an extent defined by effective system resistance from the pump assemblies, and relative pressures and load losses, which will generally vary from pump to pump from one drive system to another; setting of the motor speed is controlled directly by the computer, as is utilization of the setting tables themselves. The system is set up for operation on the basis of table data. With the viscosity table accessed, the operator enters the nominal number of half-steps the motor 26 must turn in order to dispense 1/96 of a European metric fluid ounce, say, 30.38 half-steps, then checks the effective weight of the droplet produced downstream of the pump 25 and upstream of the relative solenoid valve 10, comparing this with the nominal weight, which is the product of the specific weight given by the table of coloring agents and the volume delivered by the pump during the number of half-steps in question. Where the effective weight and nominal weight do not coincide, the nominal number of half-steps (30.38 in the example) must be altered to compensate for the greater or lesser weight delivered by the pump, by an amount calculated thus: nominal weight: half-steps=effective weight: R, where R is the effective number of half-steps which replaces the nominal 30.38, if necessary.

As far as regards the table of solenoid valve delay values, in the instance described above, where 50/96 of a metric fluid ounce must be dispensed with a delay of 8.512 half-steps (equivalent to 7 msec), the valve operation delay is checked by making a further comparison between nominal and effective weight of the droplet downstream of the valve, adopting the same criteria as that described for the viscosity setting following comparison upstream of the valve and downstream of the pump, and correcting the value accordingly. It will be appreciated that the results produced by such comparison, expressed in terms of weight, can be converted into volumetric data.

In practical application, the option exists of embodying components other than as illustrated and described, for example, the position of keys 44 and 45 . . . 53 on the pad 25 is by no means binding, and the pumps 25 and solenoid valves 10 might be any of several suitable types. Likewise, the unit of measure used for reference purposes could be other than the fluid ounce, and the numbers n and m, 16 and 96 respectively could be greater or less.

The invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A machine for batching coloring agents into a paint or varnish medium by volume comprising:

a housing; a plurality of reservoirs mounted within said housing and adapted each to contain a liquid coloring agent, and stirring means disposed within each reservoir for stirring the coloring agent therein;

n nozzles for dispensing coloring agents into said medium;

n pumps and n solenoid valves;

conduit means for connecting each reservoir with a nozzle through a pump and solenoid valve whereby the pump will pump coloring agent from the reservoir through the valve and through the nozzle when the valve is open and for returning coloring agent to the reservoir when the valve is closed;

an electric stepping motor means operably coupled to each pump for driving said pumps; and microprocessor control means coupled to said motor and to each of said valves for opening and closing only predetermined valves in a predetermined sequence and for stepping said motcr means in a predetermined number of steps during said sequence;

whereby when the microprocessor control means calibrates said machine to compare the pump flow rate for each pump, and corrects said flow rate comparison for the viscosity of each coloring agent and the time delay for opening and closing each solenoid valve, the quantity of agent dispensed through each nozzle first step of said motor is calculated so that only predetermined quantities of predetermined sequence as said microprocessor control means steps said motor and opens and closes aid valves.

2. The machine of claim 1 wherein said housing defines two compartments, each containing a plurality of said reservoirs, and a central platform adapted to mount a container of said medium, said machine further comprising:

means for raising and lowering said platform predetermined distances;

photocell means mounted adjacent said platform and coupled to said control means for signaling the presence of a container on said platform;

bank means disposed above said platform for mounting said nozzles so that when a container is disposed on said platform said nozzles will be directed downwardly thereinto.

3. The machine of claim 2 further comprising opposed output shafts extending outwardly from either side of said stepping motor;

first pulley and belt means coupled to one of said shafts and to n/2 pumps and second pulley and belt means coupled to the opposite shaft and the remaining pumps whereby when said shafts rotate said pumps will be driven thereby.

4. The machine of claim 3 wherein said microprocessor control means includes a computer having a video screen display, a printer, and a keyboard, said keyboard comprising:

a plurality of first keys for entering batch quantities of medium and admixture of coloring agents;

second key for checking on coloring agent batch data at the start of each work shift;

third key for checking on the level of coloring agent in each container;

fourth key for producing a display of remarks;

fifth key for producing a printout of batched formula on said printer;

sixth key for instructing dispensing of selected coloring agents from said nozzles;

seventh key for memorizing batch formula;

eight key for accessing tables with settings of viscosity of coloring agents, delay times for operation of solenoid valves, and speed of the motor;

ninth key for selecting a batch formula already on file;

tenth key for permitting the development of new batch formula which can also be inputted by manual operation of nozzles.

5. The machine of claim 4 wherein said computer comprises a plurality of circuit boards including a main circuit board, a board supplying power to the main circuit board, a central processing unit interface board;

an input board controlling machine functions including said photocell detecting means; an output board controlling operation of the solenoid valves; an output board controlling operation of the machine stirrers and means for raising and lowering said platform; and power supply to the motor including a step count; and a permanent memory interface.

6. A method for batching coloring agents into a paint or varnish medium by volume comprising the steps of:

providing a machine including a housing;

n reservoirs mounted within said housing and adapted each to contain a liquid coloring agent, and stirring means disposed within each reservoir for stirring the coloring agent therein;

n nozzles for dispensing coloring agents into a paint or varnish medium;

n pumps and n solenoid valves;

conduit means for connecting each reservoir with a nozzle through a pump and a solenoid valve whereby the pump will pump coloring agent from the reservoir through the valve and through the nozzle when the valve is open and for returning coloring agent to the reservoir when the valve is closed; electric motor means operably couple to each pump for driving said pump; and microprocessor control means coupled to said motor and to each of said valves for opening and closing predetermined valves in a predetermined sequence and for stepping said motor in a predetermined number of steps during said sequence;

calibrating said machine by comparing the pump flow rate for each pump and correcting said flow rate for the viscosity of each coloring agent and the time delay for opening and closing each solenoid valve so that the pump flow rate per step of the motor is calculated;

dispensing predetermined quantities of predetermined agents is predetermined sequence through said nozzles by operating and closing predetermined valves as said motor steps.

* * * * *